US006252493B1

(12) United States Patent
Gunchenko

(10) Patent No.: US 6,252,493 B1
(45) Date of Patent: Jun. 26, 2001

(54) HIGH CURRENT VARISTOR

(75) Inventor: Joseph Gunchenko, Lansdale, PA (US)

(73) Assignee: The Wiremold Company Brooks Electronics Division, Philadelphia, PA (US)

( * ) Notice: Subject to any disclaimer, the term of this patent is extended or adjusted under 35 U.S.C. 154(b) by 0 days.

(21) Appl. No.: 09/697,391

(22) Filed: Oct. 27, 2000

(51) Int. Cl.[7] ..... H01C 7/10; H01C 7/13
(52) U.S. Cl. ..... 338/20; 338/21; 361/126
(58) Field of Search ..... 338/20, 21; 361/110, 361/111, 126, 127

(56) References Cited

U.S. PATENT DOCUMENTS 4,345,290 * 8/1982 Johnson ..... 361/56
4,780,598 * 10/1988 Fahey et al. ..... 219/511
5,559,663 * 9/1996 Tanaka et al. ..... 361/127
5,912,611 * 6/1999 Berggren et al. ..... 338/21

* cited by examiner

*Primary Examiner*—Michael L. Gellner
*Assistant Examiner*—Kyung S. Lee
(74) *Attorney, Agent, or Firm*—McCormick, Paulding & Huber LLP

(57) ABSTRACT

A metal oxide varistor comprises a hollow ceramic body having an opening, a first electrode within the body and having a portion extending through the opening, and a second electrode disposed on the exterior surface of the body. Voltage applied to the electrodes above the device clamping voltage causes the ceramic body to conduct. The geometry of the body, which is optimally a sphere, greatly increases surface area between the electrodes and the ceramic body, and consequently increases the device's current carrying capacity.

13 Claims, 3 Drawing Sheets

HIGH CURRENT VARISTOR

FIELD OF THE INVENTION

This invention relates to metal oxide varistors. More particularly, this invention relates to a novel configuration for such a varistor that greatly increases the current carrying capabilities over the disc or "hockey puck" shaped metal oxide varistors.

BACKGROUND OF THE INVENTION

Polycrystalline metal oxide varistors, commonly known as MOV's, are well known in the art. MOV's include metal electrodes separated by sintered ceramics comprising a variety of metal oxides, zinc oxide being the predominant ceramic with lesser quantities of other oxides added in, including but not limited to oxides of bismuth, manganese, cobalt, antimony and/or tin. The metal electrodes may be made of any conductive material and are typically disposed on opposed major surfaces of the ceramic substrate.

MOVs commonly have the geometry of a circular disc shape with a thickness much smaller than the radius of the disc. A generic embodiment of a prior art MOV is shown in FIG. 1, wherein a ceramic substrate 11 in the shape of a disc separates a circular shaped first electrode 14 from a circular shaped second electrode 18. Such disc-type MOV's are typically coated with a non-conductive material to prevent arcing between the electrodes about the cylindrical sides of the disc.

MOV's are provided in electrical parallel with a parent electrical circuit. Current travels, if at all, from one electrode to the other through the ceramic substrate, which acts as a variable resistor (varistor). The principal advantage of MOV's is that the electrical conductivity of the ceramic substrate changes non-linearly with respect to the voltage applied. The voltage at which an MOV's electrical conductivity dramatically changes is referred to as the clamping or breakdown voltage. When the applied voltage is below the threshold or clamping voltage of the MOV, the device acts as an open circuit and virtually does not conduct. When the device is electrically connected in parallel with a parent circuit, and an over-voltage condition occurs (as often happens during a surge), the voltage may rise well over the nominal operating voltage of equipment located in the parent circuit. When this surge exceeds the clamping or breakdown voltage, the MOV's ceramic substrate will breakdown electrically, thus creating a virtual short circuit in parallel with the load; conducting the surge away from the parent circuit and associated protected equipment. MOVs behave electrically much like two Zener diodes facing each other in series. Like such an arrangement, MOVs are bi-directional.

The electrical properties of MOV's may be described by the following equation:

$$I = \left(\frac{V}{C}\right)^{\alpha}$$

wherein:

I is the current through the MOV,

V is the voltage across the electrodes,

C is a constant dictated by the substrate material and its geometric configuration, and $\alpha$ is a constant for a particular range of current across the electrodes.

Regarding the constant C in the above equation, the clamping voltage of a particular MOV is a function of the thickness of the particular substrate material interposed between the electrodes. Thicker substrates exhibit higher clamping and breakdown voltages. However, the amount of surge current that a particular MOV can effectively dissipate also is a function of the surface area of the electrode/substrate juncture. If the surge current is too great for this surface area and for the mass of the varistor substrate, the device will be destroyed due to its inability to dissipate the surge energy and the high impedance that may be posed by the insufficient surface area of the electrode/substrate juncture. This destruction often results in a catastrophic failure of the varistor device, and depending on the mode of failure may also result in a condition known as thermal runaway. While prior art MOV's encompass a wide variety of clamping voltages, many are limited in their ability to carry significant current capacities. In order to carry higher currents, the radius of disc-shaped MOVs must be increased. This is undesirable because of the extra space such an MOV would occupy in a circuit board for example. Thus, what is needed in the art is a metal oxide varistor of more compact shape that can dissipate higher currents without undergoing thermal runaway and/or catastrophic failure.

SUMMARY OF THE INVENTION

The present invention comprises an MOV with significantly increased surface area per unit volume, thus yielding an MOV with a greater current carrying capability. Specifically, a metal oxide varistor assembly comprises a hollow ceramic substrate, or body, having a generally concave interior surface and a generally convex exterior surface that are substantially complementary to each other. The hollow body has at least one opening therethrough. A first electrode is in electrical contact with the interior surface and has a portion that extends through the hollow body opening. If the hollow body defines more than one opening, the extension of the first electrode penetrates only one such opening. A second electrode is in electrical contact with the exterior surface.

The term 'generally concave' is not limited to curved surfaces, but also encompasses a plurality of planar surfaces that define a hollow. The term 'generally convex' is similarly broad, not limited to curved surfaces but also encompassing a plurality of planar surfaces whose normals diverge. For example, the interior and exterior surfaces of a pyramid formed by four planar triangles fall within the generally concave and generally convex descriptors, respectively. The term 'substantially complementary' surfaces refers to surfaces that are substantially similar in shape but not necessarily parallel. The hollow ceramic body may have a uniform thickness t between the interior and exterior surfaces in which case the surfaces are parallel. Alternatively, there may be instances where areas of reduced thickness are desired to control overshoot and upturn through the varistor, in which case the opposed surfaces will not be parallel but will still be substantially complementary. A spherical body defining a non-concentric and nearly spherical cavity exhibits substantially complementary surfaces since the interior and exterior surfaces are geometrically very similar. Conversely, a cube defining an internal spherical cavity does not exhibit substantially complementary surfaces.

The most practical embodiments of the present invention are those wherein the interior and exterior surfaces of the ceramic body are defined by body radii and the cross sections of the ceramic body include plane regions, of which some fully enclose and some partially enclose a hollow. The volumes of many solid or hollow bodies can be defined by the 'method of slicing'. Suppose for example that the body is bounded by two parallel planes perpendicular to the x axis at x=a and x=b. Imagine the body to be cut into thin slices of thickness Δx by planes perpendicular to the x axis. Then the total volume of the body (enclosed by the exterior surface) can be defined as the sum of the volumes of these slices. Similarly, the volume of the hollow interior portion of the body can be defined as the sum of the volumes of the hollow of these slices. These bodies of the more practical embodiments are defined by the radii whose origin(s) is/are enclosed by the hollow body, such as a sphere, a cone, an ellipse, and variations thereof stretched or compressed along one or more axes.

In the preferred embodiment of the present invention, a metal oxide varistor assembly comprises a ceramic substrate formed into a hollow spherical body. Other hollow and partially hollow shapes, whether or not that hollow shape is a body of revolution, are included within the concept of this invention. A sphere is an ideal shape for maximizing the amount of surface area per unit volume. By the arrangement described herein, it will be appreciated that this spherical shape is employed to maximize the unit volume surface area between the electrodes and the ceramic substrate, and thus the current carrying capability of a varistor. Certain of the claims employ the term 'equivalent spherical diameter' which is the diameter of the sphere that occupies the same volume as the hollow defined by the non-spherical body in question. For example, a cube having equal interior dimensions of 5 mm and bounded on five sides so that a single side remains open defines a volume of 125 $mm^3$, and therefore has an equivalent spherical diameter of approximately 3.102 mm.

Surfaces of the varistor adjacent to conductive portions but not intended to be an electrical conduit may optionally be coated with a non-conductive material to prevent arcing. Surfaces of the varistor through which current is intended to pass when the clamping voltage is exceeded are covered with a conductive coating to maximize the effective surface area and minimize the actual current density. Specifically, the interior concave surface and the exterior convex surface of the ceramic base or substrate is coated with a conductive coating.

The substrate may be formed in a variety of irregular shapes but the surface area between the electrodes and the substrate should be maximized to realize the advantages of the present invention. Certain non-spherical shapes may be dictated by external factors such as space limitations within a given parent circuit. These shapes are minor variations and are within the scope of this disclosure and the broader of the ensuing claims. For example, given a cubical space limitation on a circuit board of 24 mm on each side and a clamping voltage requiring a 2 mm thick substrate, a spherical MOV tailored to fit within the space would be limited to a cavity having a 10 mm radius and a cavity surface area of 1256 $mm^2$. That same space may be occupied by a cubical MOV varistor device (with its own particular electrodes) having a shape of 20 mm square sides and yielding a surface area of 2400 $mm^2$. Such a cubical shape is included within the terminology of equivalent spherical radius (approximately 14 mm in the case of the cube above).

The area of contact between the electrodes and the substrate material in each of the above-described embodiment is substantially increased as compared to prior art disc or hockey puck shaped devices. For example, a disc or puck shaped MOV tailored to the above space limitation yields a surface area of 452 $mm^2$, substantially less than either the spherical or the cubical embodiment. The current carrying ability of MOV's of the present invention is commensurately increased. An MOV constructed in accordance with the present invention can advantageously be configured in electrical series with one or more fuses to give added advantages over prior art MOV installations. Such configurations are described in more detail below.

DETAILED DESCRIPTION OF THE PREFERRED AND ALTERNATIVE EMBODIMENTS

Figure 1:
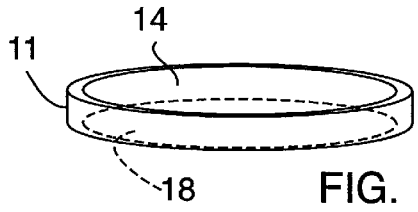
FIG. 1 PRIOR ART
FIG. 1 is a perspective view of a disc shaped MOV of the prior art.
Figure 2:
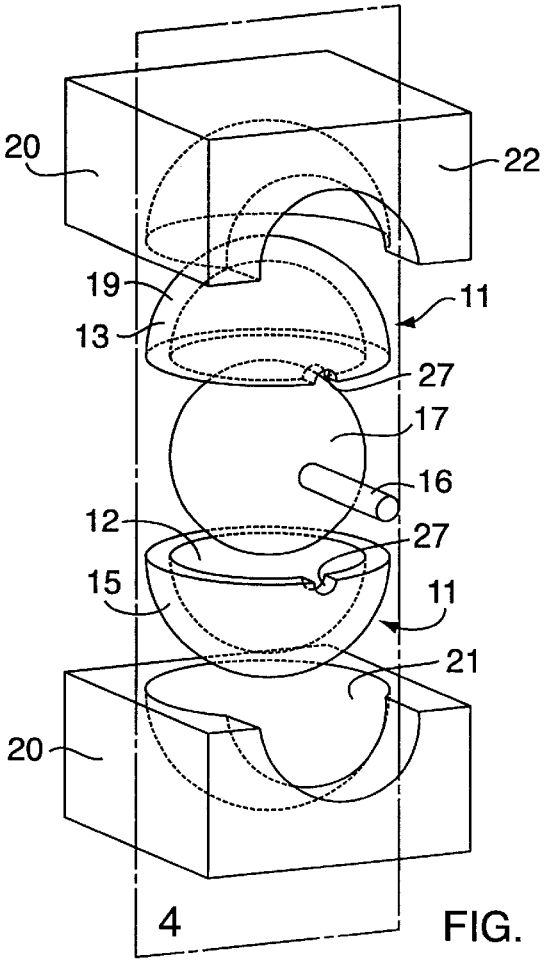
FIG. 2 is an exploded perspective view of the preferred embodiment of the present invention.

In the preferred embodiment depicted in FIG. 2, a metal oxide varistor of the present invention is shown comprising a substrate 11 of metal oxide ceramic in the shape of a sphere having an interior surface 12 and an exterior surface 13. A first conductive coating 15 is disposed on said interior surface 12. A first electrode comprises the first conductive coating 15, a lead 16, and a conductive electrode 17 that electrically connects said first conductive coating 15 to said lead 16. The lead 16 protrudes beyond the confines of the sphere through an opening 27 defined by the substrate 11. A single opening is one that breaches each of the interior and exterior surface once. In this embodiment, the surface of the conductive electrode 17 that is shown in FIG. 2 is complementary to the interior surface 12 of the substrate 11 to electrically contact a substantial area of the interior conductive coating 15. A second conductive coating 19 is disposed on the exterior surface 13 and covers a substantial portion thereof. A second electrode 18 comprises the second conductive coating 19, and an outer conductive body 20 that has an inside surface 21 substantially enveloping said first conductive coating 19 and in electrical contact therewith. The inside surface 21 of the conductive body 20 is complementary in shape to the substrate exterior surface 13 to electrically contact a substantial area of said exterior conductive coating 19. The outer conductive body 20 further defines an outside surface 22, the shape of which is not critical to the operation of the present invention, but which is shown as a cube in the associated figures.

Figure 3:
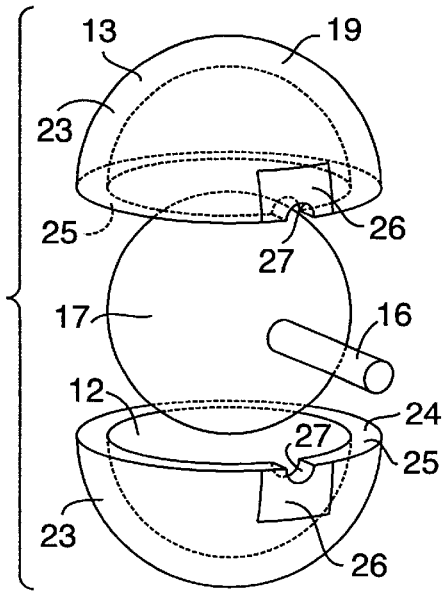
FIG. 3 is identical to FIG. 2 except the outer conductive body is not shown to better illustrate electrical isolation of various components.

The outer conductive body 20 is not shown in FIG. 3 to better illustrate electrical isolation of the first electrode 14 from the second conductive coating 19. The substrate 11, interior and exterior surfaces 12 and 13, and first and second conductive coatings 15 and 19 are as described in FIG. 2 above. However, the substrate 11 can be, but need not necessarily be sectioned into two opposing hemispheres 23 each defining a ringed surface 24. These ringed surfaces 24 may be covered with a substantially non-conductive coating 25 to preclude leakage that would otherwise occur through the juncture they define when the hemispheres 23 are assembled.

A patch 26 comprises a substantially non-conductive coating (similar to that on the ringed surfaces 24 of the hemispheres 23 described above) that is immediately adjacent to the lead 16. The patch 26 may be disposed on a portion of the substrate exterior surface 13, or on a portion of the second conductive coating 19. The patch 26 serves to electrically insulate the lead 16 from the second conductive coating 19. The MOV's current carrying capacity is a function of the surface area of the smallest electrode/substrate juncture. Therefore, the current carrying capacity of the device is not impaired so long as the area of the patch 26 is less than the difference in area between the interior 12 and exterior 13 surfaces of the sphere. In certain instances such as where the substrate thickness is very thin or where very high clamping and breakdown voltages are desired, the size of the patch 26 may need to be increased in order to prevent electrical continuity, conduction, and arcing between the lead 16 and the exterior conductive coating 19. Regardless, the unit volume current carrying capacity of such a device still substantially exceeds that of conventionally shaped MOV's.

The conductive electrode 17 is preferably a solid conductive material, but may alternatively be any conductive spherical material such as a solder filled or poured cavity. When the electrode 17 is hollow, it may be filled with a material that gives additional structural integrity (especially in compression) and/or an economic advantage over a solid metallic ball. Additional considerations for such a filler material are conductivity and heat absorption capacity. Structural integrity is important primarily during assembly; very thin substrates are subject to fracture, and dents in the surface of the ball can reduce the effective size of the electrode/substrate juncture. The latter discrepancy will also diminish the current carrying capacity of the assembled device. Conductivity is important to ensure current flows freely across the entire surface of the ball to fully exploit the entire surface area in contact with the ceramic substrate. Heat capacity may become relevant in certain applications where extremely high peak currents are to be carried by the device, or during thermal runaway conditions. The second or outermost electrode must, of course, survive all heat generated in a steady state, non-peak, or transient condition.

Figure 4:
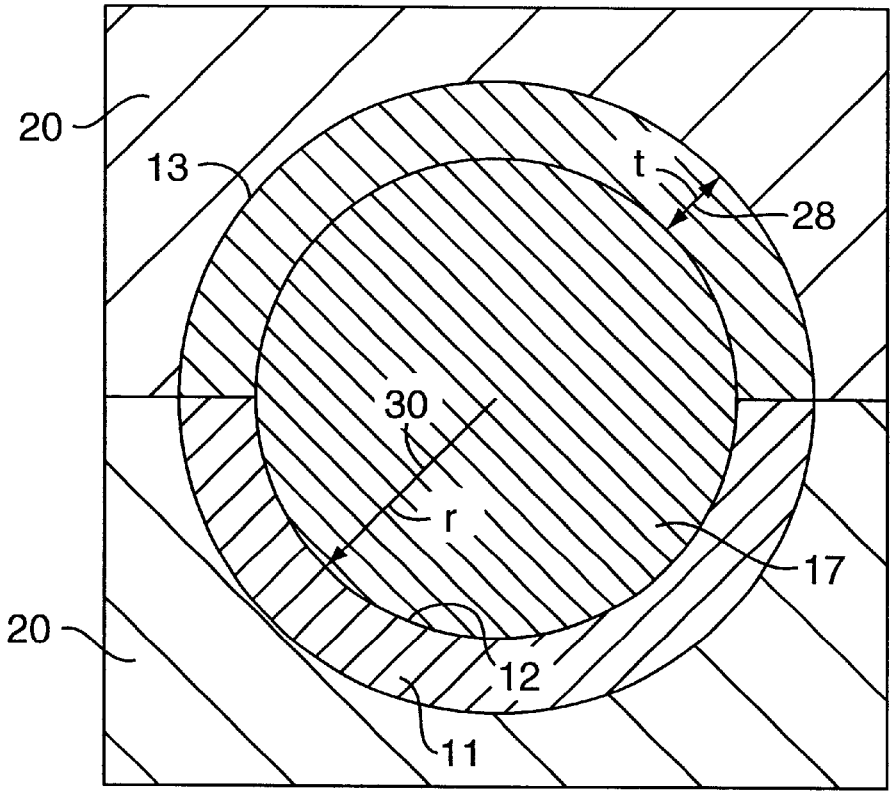
FIG. 4 is a planar cross section taken along plane 4 of FIG. 2.

A planar cross section 4 of the device depicted at FIG. 2 is shown more particularly at FIG. 4, wherein the planar cross section 4 defines an ellipse so that an interior section is enclosed. A sphere is a special case of an ellipsoid, and is the embodiment that maximizes electrode surface area per unit volume. The substrate 11 has a wall thickness 28 that is constant throughout this embodiment, but certain applications may employ an area of lesser thickness to control upturn and overshoot, as well as various breakdown and clamping voltages. FIG. 4 shows the cavity defined by the interior surface 12 having an equivalent spherical radius 30 of the cavity. Where t represents the minimum wall thickness and r represents the equivalent spherical radius, the embodiment of FIG. 4 shows that r>t. An equivalent spherical radius is the radius of that sphere occupying the same volume as the actual cavity defines. In FIG. 4, the equivalent spherical radius r is the actual radius since the cavity is a sphere.

Figure 5:
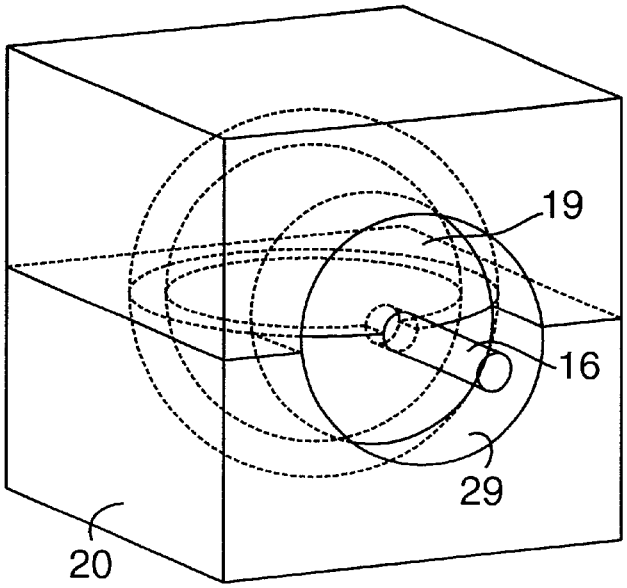
FIG. 5 is the assembled components of FIG. 2 with interior sections in shadow.

FIG. 5 shows the assembled device with interior sections in shadow. The outer conductive body 20 defines an enlarged penetration 29 by which the lead 16 passes through. The lead 16 does not electrically communicate with either the second conductive coating 19 or the outer conductive body 20, either by contact or arcing. The outer conductive body 20 and the second conductive coating 19 are thus electrically insulated from the first conductive coating 15 and the lead 16 except through the substrate 11. Thus current flows, if at all, from either the first or second electrode through the substrate to the alternate electrode.

Alternative embodiments of the present invention include variations of the spherical geometry of the preferred embodiment's substrate. Physical constraints of a particular varistor application may favor the use of a non-spherical ellipsoid that may be stretched or compressed along one or more of its axes, the resultant shape still being substantially an ellipsoid. Varistor geometry may be optimized for a given external constraint such as space limitations or manufacturing capability. Substantially planar components may be assembled to form, for example, a body having four or more sides, or may be combined with curved geometric segments that define various interior sections when assembled. Each of the above embodiments are minor variations of the preferred spherical or ellipsoid embodiment and are within the teachings of this disclosure and the ensuing claims.

Figure 6:
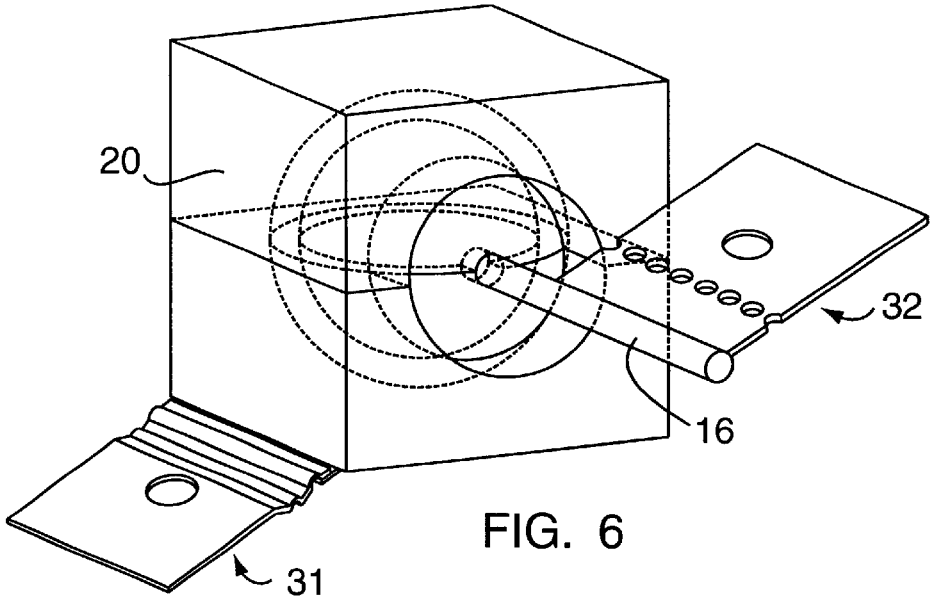
FIG. 6 is a drawing of the MOV of FIG. 5 in electrical series with both a thermal and a transient fuse, the MOV disposed therebetween.

Any of the MOV embodiments described above may be configured in electrical series with one or more fuses, and the MOV of FIG. 5 is taken as an illustrative example. FIG. 6 depicts an MOV of the present invention in series with a thermal fuse 31 and a transient fuse 32, wherein the MOV is disposed therebetween. The order of the components may be varied from that shown. The MOV of the present invention can be alternatively configured with either of these fuses individually.

Figure 7:
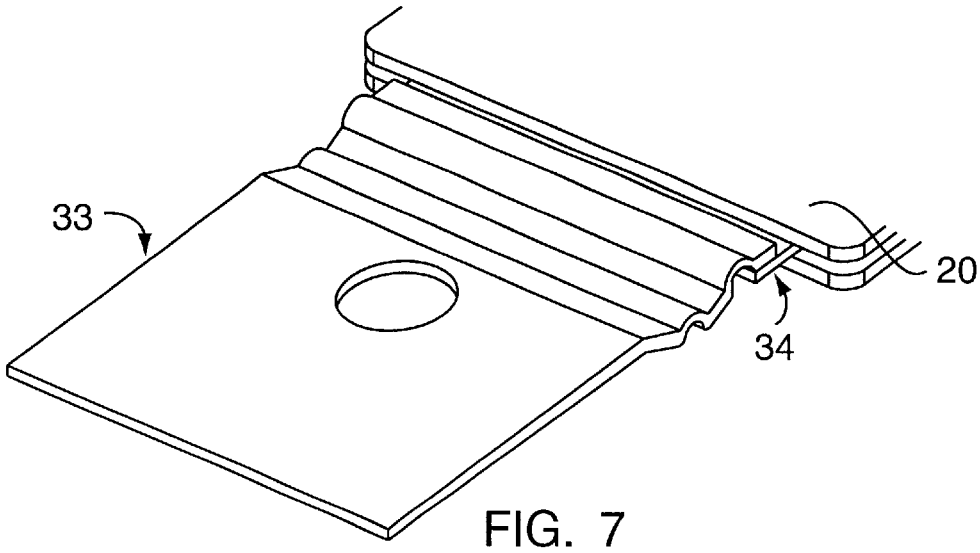
FIG. 7 is a detailed view of the thermal fuse of FIG. 6 in isolation.

The MOV in series with a thermal fuse 31 only, as depicted in FIG. 6 when the transient fuse 32 is ignored, gives the advantage of protecting the MOV from thermal runaway. Any of the thermal fuses well known in the art is adapted to disconnect the MOV from the parent circuit immediately prior to or during the MOV experiencing thermal runaway. FIG. 7 depicts the thermal fuse 31 of FIG. 6 in isolation, wherein a spring loaded connector 33 for connecting to an external circuit or device is held to an extension of the outer conductive body 20 of an MOV at a thermo-sensitive junction 34. The thermo-sensitive junction may be completed by a solder alloy having a low melting temperature, which are well known in the art. Also well known in the art are transient fuses, and an MOV of the present invention is shown in series therewith in FIG. 6. The transient fuse 32 disconnects the MOV from the parallel parent circuit across which it is connected. Certain electrical events such as a surge associated with a lightning strike may still cause an over-current condition, exceeding even the increased current-carrying capabilities of MOVs of the present invention. During these instances, the transient fuse 32 physically interrupts current through the MOV and prevents its complete or catastrophic destruction. FIG. 6 taken in whole shows the MOV of FIG. 5 in electrical series with a thermal fuse 31 and a transient fuse 32 wherein the MOV is disposed between these opposing fuses and thereby gains each or a combination of the advantages described above. These advantages may be gained even by changing the order of the MOV(s) and the fuses so long as they remain in series with respect to each other. This entire combination of MOV(s) and fuses remains in electrical parallel with the parent circuit requiring protection.

While the preferred embodiment and several variations have been shown and described, additional various modifications and substitutions will be apparent to those skilled in the art and may be made without departing from the spirit and scope of the present invention. The embodiments described above are hereby stipulated as illustrative rather than exhaustive.

I claim:

1. A metal oxide varistor assembly comprising:

a hollow ceramic body having a concave interior surface and a convex exterior surface, said surfaces complementary to each other geometrically, said body further having at least one opening therethrough;

a first electrode in electrical contact with said concave interior surface and having a portion that extends through said at least one opening; and a second electrode in electrical contact with said convex exterior surface, said first and second electrodes isolated from electrical contact with each other except through said ceramic body.

2. The assembly of claim 1 wherein said hollow ceramic body has a substantially uniform thickness t such that said interior and exterior surfaces are of the same concave and convex geometry respectively.

3. The assembly of claim 2 wherein said first electrode includes a first conductive coating disposed on said concave interior surface of said hollow ceramic body, and said first electrode further includes a first member shaped to fit inside said hollow ceramic body, said first member being in electrical contact with said first conductive coating.

4. The assembly of claim 2 wherein said second electrode includes a second conductive coating disposed on said convex exterior surface of said hollow ceramic body, and said second electrode further including a second member substantially surrounding said hollow ceramic body, said second member being in electrical contact with said second conductive coating.

5. The assembly of claim 1 wherein said hollow ceramic body has a minimum thickness $t_{min}$ that is less than its equivalent spherical radius r, wherein r is the radius of a sphere occupying the same volume as a cavity defined by said interior surface of said hollow ceramic body.

6. The assembly of claim 1 further including at least one thermal electrical fuse connected in electrical series with one of said first and second electrodes.

7. The assembly of claim 1 further including at least one transient electrical fuse connected in electrical series with one of said first and second electrodes.

8. The assembly of claim 1 further including at least one thermal electrical fuse and at least one transient electrical fuse connected in electrical series with one of said first and second electrodes, one of said first and second electrodes being disposed between said fuses.

9. A metal oxide varistor assembly comprising:

a hollow ceramic substrate characterized by a ellipsoid shape and having a concave interior and a convex exterior surfaces, a first electrode in electrical contact with said interior surface, and a second electrode in electrical contact with said exterior surface, said first and second electrodes in electrical communication only through said substrate so that a voltage in excess of a breakdown clamping voltage is required for the assembly to conduct.

10. The assembly of claim 9 wherein said hollow ceramic substrate interior surface has a first conductive coating disposed on a substantial portion of said interior surface.

11. The assembly of claim 10 wherein said hollow ceramic substrate has an opening therethrough; and said first electrode having a first portion shaped complementary to said interior surface and in electrical contact with said first conductive coating, and a second portion extending through said opening in said substrate.

12. The assembly of claim 9 wherein said hollow ceramic substrate is defined by at least two mating semi-ellipsoidal shells, said interior shell surfaces having conductive coatings that are in electrical contact with each other.

13. The assembly of claim 12 wherein said second electrode further includes a hollow conductive body having an internal cavity shaped complementary to and substantially enveloping said hollow ceramic substrate convex exterior surface.

* * * * *